United States Patent [19]

Nakamura et al.

[11] 4,392,788

[45] Jul. 12, 1983

[54] SWASH-PLATE TYPE COMPRESSOR HAVING OIL SEPARATING FUNCTION

[75] Inventors: Teruo Nakamura; Umetarou Iino, both of Konan, Japan

[73] Assignee: Diesel Kiki Co., Ltd., Tokyo, Japan

[21] Appl. No.: 290,874

[22] Filed: Aug. 7, 1981

[30] Foreign Application Priority Data

Aug. 15, 1980 [JP] Japan ..... 55-112327
Aug. 15, 1980 [JP] Japan ..... 55-112328

[51] Int. Cl.[3] ..... F04B 1/18
[52] U.S. Cl. ..... 417/269; 92/79
[58] Field of Search ..... 417/269; 92/79

[56] References Cited

U.S. PATENT DOCUMENTS 4,283,997 8/1981 Takahasi ..... 92/79
4,290,345 9/1981 Hiraga ..... 92/79
4,351,227 9/1982 Copp ..... 417/269

*Primary Examiner*—William L. Freeh
*Attorney, Agent, or Firm*—Frishauf, Holtz, Goodman & Woodward

[57] ABSTRACT

A partition member divides the interior of the rear cylinder head into a low pressure chamber and a high pressure chamber on one side of the partition member facing the valve plate and into an oil separating chamber on the opposite side. Formed in the high pressure chamber at its peripheral portion are first and second oil collecting chambers which communicate with the drive shaft-fitted hole of the cylinder block, allowing lubricating oil therein to be fed to the hole. The oil separating chamber is provided with a guide wall for guiding suction fluid in a swirling manner. A third oil collecting chamber is defined between the guide wall and the inner peripheral wall of the rear cylinder head and communicates with the oil sump in the cylinder block, allowing lubricating oil therein to be returned to the oil sump.

9 Claims, 7 Drawing Figures

SWASH-PLATE TYPE COMPRESSOR HAVING OIL SEPARATING FUNCTION

BACKGROUND OF THE INVENTION

This invention relates to a swash-plate type compressor for compressing refrigerant circulating in the refrigerating circuit of an air conditioning system, or like fluid, and more particularly to a novel and efficient oil separating arrangement provided in such type compressor for separating oil from refrigerant or like fluid.

Conventionally, swash-plate type compressors are widely used as one of the compressors for compressing refrigerant circulating in an air conditioning system. A compressor of this type generally includes a cylinder block having a plurality of axial cylinder bores within which pistons are slidably received, a pair of cylinder heads rigidly mounted at the opposite ends of the cylinder block with valve plates intervening therebetween, a drive shaft extending through the cylinder block and one of the cylinder heads along their axes, and a swash plate arranged within a swash plate chamber defined within the cylinder block and rigidly fitted on the drive shaft in engagement with the pistons via shoes and balls. The drive shaft is radially supported by radial bearings, and the swash plate axially supported by thrust bearings.

In this compressor, lubricating oil is fed to sliding machine parts such as the drive shaft, the swash plate, the pistons and the bearings, to lubricate them. That is, lubricating oil stored in an oil sump located below the swash plate is splashed into oily mist to be fed to the swash plate, the thrust bearings, the balls, the shoes, the pistons, etc. to lubricate them. The oil which is fed to the pistons to lubricate the same is sucked into the compression chambers through the gaps between the pistons and the cylinder bores and then discharged into the refrigerating circuit together with compressed refrigerant.

An increased amount of oil in the refrigerating circuit causes a deterioration in the performance of the heat exchanger of the air conditioning system, leading to an inferior refrigerating capacity of the system. Further, the increased amount of oil in the refrigerating circuit causes a shortage of oil within the compressor and consequently insufficient feeding of oil to the sliding machines parts, resulting in seizure of these parts.

It is therefore necessary to separate lubricating oil entrained in the refrigerant in an efficient manner and retain the oil thus separated within the compressor.

OBJECT AND SUMMARY OF THE INVENTION

It is the object of the invention to provide a swash-plate type compressor which is provided with oil separating measures arranged in the rear cylinder head which utilizes centrifugal force to separate lubricating oil from both suction refrigerant and discharge refrigerant, and passage means for guiding the oil thus separated to the oil sump and drive shaft-fitted hole in the compressor, to thus collect lubricating oil entrained in the refrigerant circulating in the refrigerating circuit.

According to the invention, there is provided a swash-plate type compressor which includes a cylinder block horizontally disposed and having a through hole extending along its axis and an oil sump formed at the bottom, a cylinder head mounted at one end of the cylinder block and having a fluid suction prot and a fluid discharge port located on top thereof, a valve plate interposed between the cylinder block and the cylinder head, a drive shaft rotatably fitted in the through hole of the cylinder block, and a partition member arranged within the cylinder head and axially dividing the interior of the same. The partition member defines a first chamber and a second chamber concentrically arranged on one side thereof facing the valve plate, the first chamber being located radially outwardly for temporarily storing high pressure fluid being discharged, while the second chamber being located radially inwardly for temporarily storing low pressure fluid being sucked. The partition member further defines a third chamber on the other side remote from the valve plate. The third chamber, in which the above fluid suction port opens, communicates with the second chamber through a hole formed substantially centrally through the partition member for allowing suction fluid to pass therethrough before being fed to the second chamber. A pair of circumferentially extending guide members are arranged within the first chamber and define first and second oil collecting chambers located at peripheral portions of the first chamber and opening toward the fluid discharge port. First passage means communicate the first and second oil collecting chambers with the through hole of the cylinder block for guiding oil to the through hole. A guide wall is arranged within the third chamber, which defines a suction fluid passage spirally extending from the fluid suction port to the central hole of the partition member. The guide wall further defines a third oil collecting chamber at a peripheral portion of the third chamber and has a hole formed therein through which oil is introduced into the third oil collecting chamber from the suction fluid passage. Second passage means communicates the third oil collecting chamber with the oil sump for guiding oil to the oil sump.

The above and other objects, features, and advantages of the invention will be more apparent from the ensuing detailed description taken in connection with the accompanying drawings.

DETAILED DESCRIPTION

Figure 1:
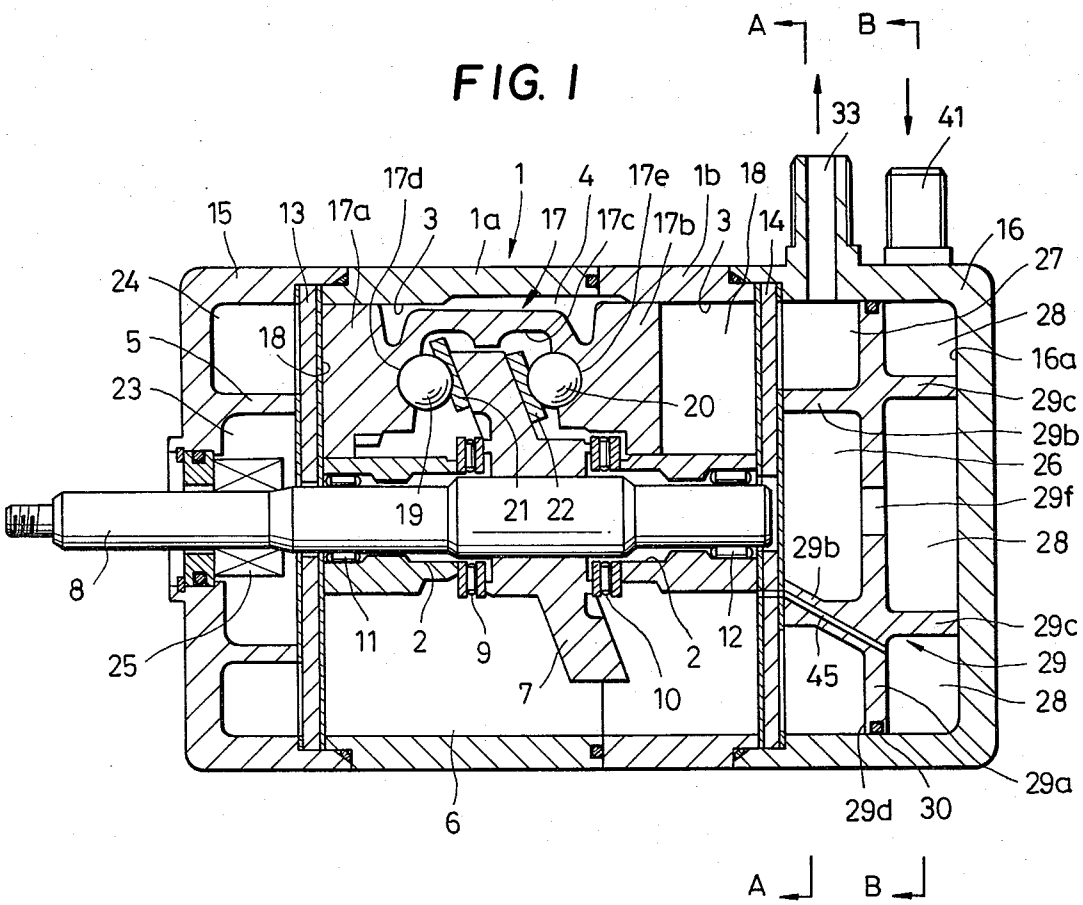
FIG. 1 is a longitudinal sectional view illustrating a swash-plate type compressor according to an embodiment of the present invention.

The invention will now be described in detail with reference to the drawings in which a preferred embodiment of the invention is illustrated.

A pair of cylindrical members 1*a*, 1*b* are combined together in axial alignment to form a cylinder block 1. The cylinder block 1 is formed with a through hole 2 extending along its axis, in which a drive shaft, hereinafter referred to, is to be fitted, and three cylinder bores 3 axially extending at circumferentially equal intervals about the through hole 2. Further, the cylinder block 1 has its central portion formed with a swash plate chamber 4 within which a swash plate 7 is received. The cylinder bores 3 each have a central opening facing the swash plate chamber 4. An oil sump 6 is formed at the bottom of the cylinder block 1 or below the swash plate chamber 4.

The swash plate 7 is rigidly fitted on the drive shaft 8 which in turn is supported by thrust bearings 9, 10 and radial bearings 11, 12 for rotation relative to the cylindrical members 1*a*, 1*b*.

A front cylinder head 15 and a rear cylinder head 16 are rigidly mounted on the opposite ends of the cylinder block 1 with valve plates 13, 14 intervening therebetween.

Double acting pistons 17 are slidably received within the cylinder bores 3 formed in the cylinder block 1. As the pistons 17 are slidingly moved, compression chambers 18 are defined by the heads 17*a*, 17*b* of the pistons 17, the cylinder bores 3 and the valve plates 13, 14. The pistons 17 each have its central portion concaved to form an engaging recess 17*c* at which the piston 17 is disposed astride the outer fringe of the swash plate 7. The engaging recess 17*c* has its opposite inner end faces formed with semispherical pockets 17*d*, 17*e* in which balls 19, 20 are received. Further, shoes 21, 22 are interposed between the balls 19, 20 and the swash plate 7. Therefore, when the swash plate 7 is rotated in unison with the rotation of the drive shaft 8, the outer fringe of the swash plate 7 is swingingly moved leftward and rightward to impart urging force to the shoes 21, 22 while sliding thereon so that the pistons 17 are forced to make reciprocating motions within the cylinder bores 3 to carry out compression actions.

The front cylinder head 15 has its interior divided by a partition wall 5 into a low pressure chamber 23 and a high pressure chamber 24. A shaft seal 25 is arranged within the low pressure chamber 23.

The rear cylinder head 16 has its interior divided into a low pressure chamber 26, a high pressure chamber 27 and an oil separating chamber 28 by a partition member 29 fitted in the internal space 16*a* of the cylinder head 16.

The partition member 29 is formed of a one-piece member which has a disc-like portion 29*a* located substantially at an axial center of the internal space 16*a* and axially dividing the same, a partition wall 29*b* formed on one side face of the portion 29*a* and defining the low pressure chamber 26 and the high pressure chamber 27, and a guide wall 29*c* formed on the other side face of the portion 29*a* in a spiral arrangement and defining the oil separating chamber 28 for regulating the flow direction of refrigerant. The disc-like portion 29*a* has its outer peripheral surface formed with an annular groove 29*d* in which an O ring 30 is fitted to seal the oil separating chamber 28 against the high pressure chamber 27. The disc-like portion 29*a* is also formed with a suction hole 29*f* at its center, through which the oil separating chamber 28 communicates with the low pressure chamber 26. The partition wall 29*b* formed on the other side surface of the disc-like portion 29*a* protrudes in an annular shape and defines the low pressure chamber 26 at a radially inward location and the high pressure chamber 27 at a radially outward location and concentrically of the chamber 26, in cooperation with the valve plate 14.

Three suction holes 31 and a communication hole 32 are bored through the valve plate 14 and all open in the low pressure chamber 26. The communication hole 32 leads to the low pressure chamber 23 in the front cylinder head 15.

Figure 2:
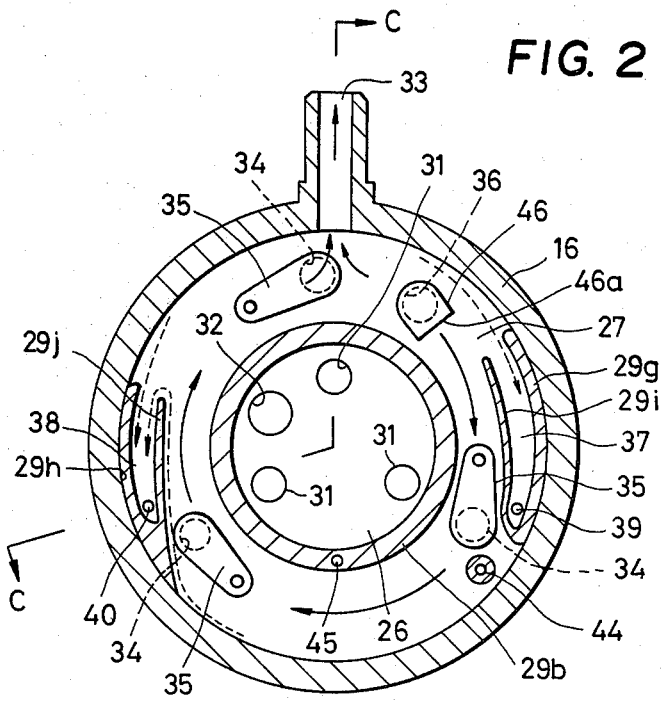
FIG. 2 is a sectional view taken along line A—A in FIG. 1.

Formed on top of the rear cylinder head 16 is a discharge port 33 which is to be connected to a condenser, not shown, and opens in the high pressure chamber 27. The valve plate 14 further has three pairs of discharge holes 34 and discharge valves 35 and a communication hole 36 communicating with the high pressure chamber 24 in the front cylinder head 15, the holes 34 and 36 opening in the high pressure chamber 27. Arranged over the opening of the communication hole 36 is a guide member 46 for turning the flow of high pressure refrigerant flowing out of the hole 36, in the clockwise direction. That is, the guide member 46 has its one end 46*a* opened through which the refrigerant flows out in the clockwise direction as indicated by the arrows in FIG. 2. Oil collecting chambers 37, 38 are formed along the inner peripheral wall of the cylinder head 16. More specifically, the oil collecting chambers 37, 38 are each defined by an outer side wall 29*g*, 29*h* extending along the peripheral edge of the disc-like portion 29*a* of the partition member 29 facing toward the valve plate 13 or along the inner peripheral wall of the cylinder head 16, and an inner side wall 29*i*, 29*j* serving as a guide member and extending from the lower end of the outer side wall 29*g*, 29*h* in parallel therewith. These oil collecting chambers 37, 38 are located on substantially the same level with the center of the high pressure chamber 27 and arranged symmetrically with respect to the discharge port 33. The chambers 37, 38 open toward the discharge port 33. The oil collecting chambers 37, 38 communicate with the drive shaft-fitted hole 2 in the cylinder block 1 through passages 39, 40 bored through the valve plate 14 and opening in the bottoms of the chambers 37, 38. Therefore, the oil collected into the chambers 37, 38 is guided into the drive shaft-fitted hole 2 to lubricate the radial bearing 12 on the rear side and then the thrust bearing 10 on the same side, and then returned to the oil sump 6.

Figure 3:
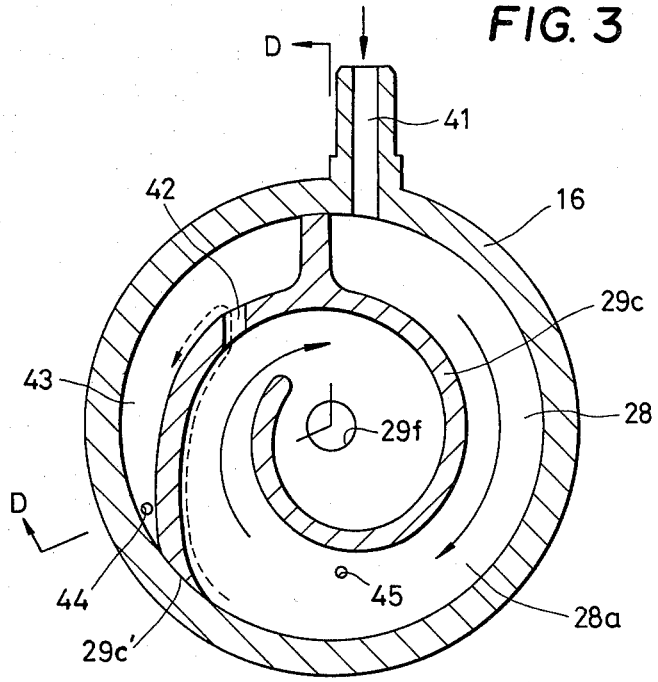
FIG. 3 is a sectional view taken along line B—B in FIG. 1.
Figure 4:
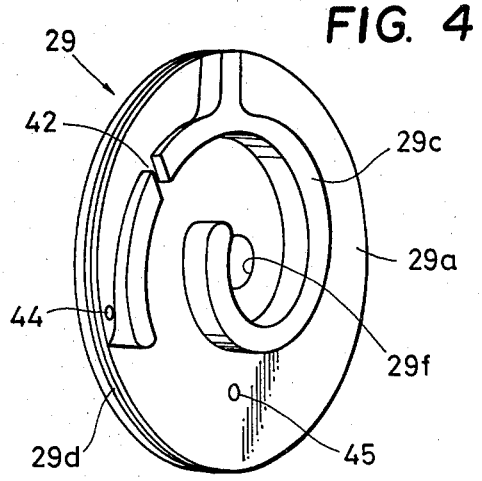
FIG. 4 is a perspective view illustrating the partition member shown in FIGS. 1 through 3.
Figure 5:
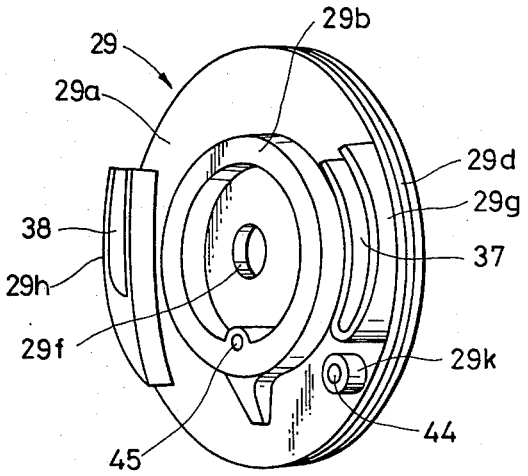
FIG. 5 is a perspective view illustrating the same partition member as viewed in another direction.
Figure 6:
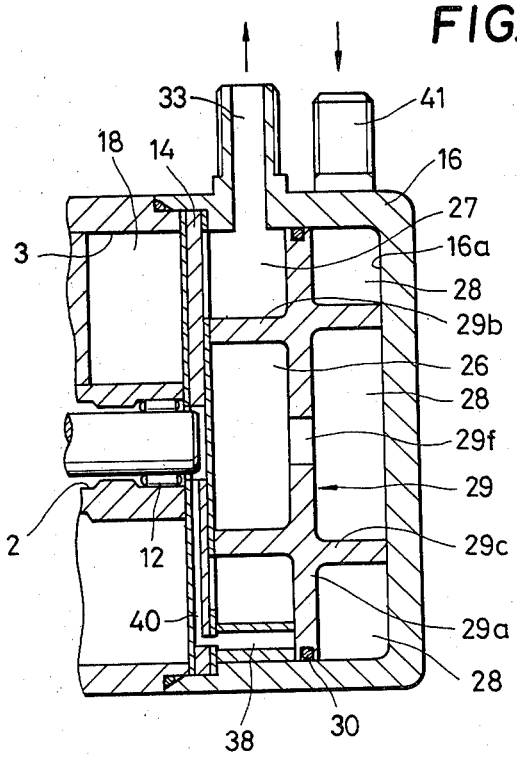
FIG. 6 is a fragmentary sectional view taken along line C—C in FIG. 2.
Figure 7:
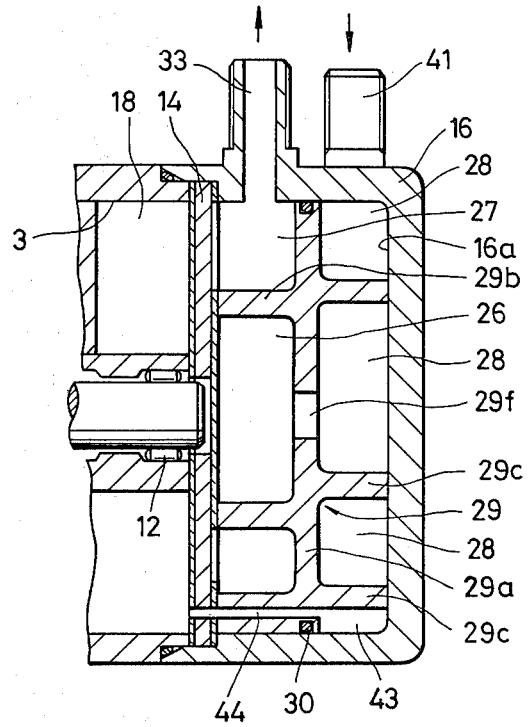
FIG. 7 is a fragmentary sectional view taken along line D—D in FIG. 3.

Formed on top of the rear cylinder head 16 is a suction port 41 which opens in the oil separating chamber 28. The oil separating chamber 28 is provided with the aforementioned spirally extending guide wall 29*c* formed integrally on the disc-like portion 29*a* of the partition member 29. This guide wall 29*c* defines a suction refrigerant passage 28*a* spirally extending from the suction port 41 to the suction hole 29*f* formed centrally of the disc-like portion 29*a*, to cause a swirling flow of refrigerant therealong. As shown in FIG. 3, the guide wall 29*c* is spiralled in the clockwise direction so as to cause clockwise turning of the flow of refrigerant. It has its lower end 29*c*′ abutting against the inner peripheral wall of the cylinder head 16 and extends from the lower end 29*c*′ in a direction gradually away from the inner peripheral wall of the cylinder head 16. It is formed with a slit-like oil intake hole 42 at a location leftward of and a little higher than the suction hole 29*f*. This guide wall 29*c* and the peripheral wall of the cylinder head 16 define an oil collecting chamber 43 having a generally inverted V shape. A passage 44 is formed through the valve plate 14 and a tubular portion 29*k* formed on the partition member 29, which opens in the bottom of the oil collecting chamber 43 to communicate the chamber 43 with the oil sump 6. Therefore, the oil collected into the chamber 43 is returned to the oil sump 6 through the passage 44.

A blow-bye gas return passage 45 is formed through the valve plate 14 and the partition wall 29*b* of the partition member 29 to communicate the upper portion of the oil sump 6 with the suction refrigerant passage 28*a* in the oil separating chamber 28. Blow-bye gas or refrigerant gas, which leaks through the gaps between the pistons 17 and the cylinder bores 3 into the oil sump 6, is guided through the passage 45 into the suction refrigerant passage 28*a* which is under lower pressure, where oil contained in the blow-bye gas is again separated.

With the above arrangement, when the drive shaft 8 rotates to cause corresponding swinging rotation of the swash plate 7, the pistons 17 engaging the swash plate 7 are reciprocatingly moved to cause alternative expansion and contraction in the volumes of the compression chambers 18. During the expansion stroke, the compression chambers 18 suck in refrigerant from the low pressure chambers 23, 26 through the suction holes 31, while during the compression stroke, they compress the refrigerant and discharge it into the high pressure chambers 24, 27 through the discharge holes 34.

Suction refrigerant emitted from the evaporator, not shown, of the air conditioning system and guided to the suction port 41 is introduced into the oil separating chamber 28. In the chamber 28, the suction refrigerant is forced to make a whirling motion by means of the guide wall 29*c*, into the suction hole 29*f* and then into the low pressure chamber 26. Due to centrifugal force caused by the whirling motion of the refrigerant, the oil contained in the refrigerant is separated from the refrigerant to adhere to the inner walls of the cylinder head 16 and the guide wall 29*c*.

The oil thus stuck on the members 16, 29*c* is moved by the refrigerant flow as indicated by the dotted line in FIG. 3, into the oil collecting chamber 43 through the oil intake hole 42. The oil thus collected into the oil collecting chamber 43 is guided through the passage 44 into the oil sump 6.

Although in the illustrated embodiment the guide wall 29*c* is formed integrally on the partition wall 29, alternatively it may be formed integrally on the cylinder head 16.

On the other hand, in the high pressure chamber 27, high pressure refrigerant is joined with high pressure refrigerant delivered from the high pressure chamber 24 in the front cylinder head 15, and collides against wall surfaces, etc. to be changed in flow direction. In the illustrated embodiment, due to the provision of the guide member 46 at the opening of the communication hole 36, the refrigerant emitted through the discharge valves 35 into the chamber 27 is swirled in the clockwise direction as indicated by the arrows in FIG. 2. The change in the flow direction of refrigerant such as swirling causes centrifugal force, which acts upon the refrigerant to cause separation of oil from the refrigerant. The oil thus separated, due to its larger specific gravity, is guided radially outwardly and carried by the flow of refrigerant flowing radially inwardly as indicated by the dotted lines in FIG. 2, to be collected into the oil collecting chambers 37, 38.

The oil thus collected into the oil collecting chambers 37, 38 is guided into the drive shaft-fitted hole 2 through the passages 39, 40, to lubricate the radial bearing 12 and the thrust bearing 10 and then returned to the oil sump 6.

Although in the illustrated embodiment the oil separating arrangement is provided in the high pressure chamber 27 and oil separating chamber 28 in the rear cylinder head 16 alone, a similar oil separating arrangement may be provided in the front cylinder head 15, too, with similar effects to those mentioned above.

While a preferred embodiment has been described, variations thereto will occur to those skilled in the art within the scope of the present inventive concepts which are delineated by the following claims.

What is claimed is:

1. A swash-plate type compressor which comprises: a cylinder block horizontally disposed and having a through hole extending along an axis thereof and an oil sump formed at a bottom thereof; a cylinder head mounted at one end of said cylinder block and having a fluid suction port and a fluid discharge port located on top thereof; a valve plate interposed between said cylinder block and said cylinder head; a drive shaft rotatably fitted in said through hole of said cylinder block; a partition member arranged within said cylinder head and axially dividing the interior thereof, said partition member defining a first chamber and a second chamber concentrically arranged on one side thereof facing said valve plate, said first chamber being located radially outwardly for temporarily storing high pressure fluid being discharged from said compressor, said second chamber being located radially inwardly for temporarily storing low pressure fluid being sucked into said compressor, said partition member further defining a third chamber on an opposite side thereof remote from said valve plate, said fluid suction port opening in said third chamber, said third chamber communicating with said second chamber through a hole formed substantially centrally through said partition member for allowing suction fluid to pass therethrough before being fed to said second chamber; a pair of guide members circumferentially extending and arranged within said first chamber, said guide members defining, respectively, a first oil collecting chamber and a second oil collecting chamber located at peripheral portions of said first chamber and opening toward said fluid discharge port; first passage means communicating said first and second oil collecting chambers with said through hole of said cylinder block for guiding oil to said through hole; a guide wall arranged within said third chamber and defining a suction fluid passage spirally extending from said fluid suction port to said central hole of said partition member, said guide wall further defining a third oil collecting chamber at a peripheral portion of said third chamber, said guide wall having a hole formed therein through which oil is introduced into said third oil collecting chamber from said suction fluid passage; and second passage means communicating said third oil collecting chamber with said oil sump for guiding oil to said oil sump.

2. The swash-plate type compressor as claimed in claim 1, wherein said first and second oil collecting chambers are located on a level substantially the same as the center of said first chamber and arranged symmetrically with respect to said fluid discharge port.

3. The swash-plate type compressor as claimed in claim 1, wherein said pair of guide members each comprise an outer side wall extending along a peripheral edge of said partition member and an inner side wall extending in parallel with said outer side wall, said outer side wall and said inner side wall defining therebetween a corresponding one of said first and second oil collecting chambers.

4. The swash-plate type compressor as claimed in claim 1, further comprising: a second cylinder head mounted at another end of said cylinder block and having a fourth chamber defined therein for temporarily storing high pressure fluid being discharged from said compressor; a passage communicating said fourth chamber with said first chamber; and guide means arranged at an opening of said passage in said first chamber for guiding said high pressure refrigerant emitted from said passage so as to flow in a predetermined circumferential direction.

5. The swash-plate type compressor as claimed in claim 1, wherein said guide wall has one end thereof abutting against an inner peripheral wall of said cylinder head, said guide wall extending from said one end thereof in a direction gradually away from said inner peripheral wall of said cylinder head to define said third oil collecting chamber in cooperation with said inner peripheral wall of said cylinder head, said guide wall having a hole formed therethrough at a location higher than said central hole of said partition member, for introducing oil into said third collecting chamber from said suction fluid passage.

6. The swash-plate type compressor as claimed in claim 1, wherein said guide wall is formed integrally on said partition member.

7. The swash-plate type compressor as claimed in claim 1, wherein said first passage means comprises passages formed through said valve plate.

8. The swash-plate type compressor as claimed in claim 1, wherein said second passage means comprises a passage formed through said partition member and said valve plate.

9. The swash-plate type compressor as claimed in any one of the preceding claims, further comprising a passage formed through said valve plate and said partition member and communicating an upper portion of said oil sump with said suction fluid passage for guiding gaseous fluid in said oil sump into said suction fluid passage.

* * * * *